US008941539B1

(12) United States Patent
Bharghavan et al.

(10) Patent No.: US 8,941,539 B1
(45) Date of Patent: Jan. 27, 2015

(54) DUAL-STACK DUAL-BAND MIMO ANTENNA

(75) Inventors: Vaduvur Bharghavan, Morgan Hill, CA (US); Rajendran Chary, Cupertino, CA (US)

(73) Assignee: Meru Networks, Sunnyvale, CA (US)

( * ) Notice: Subject to any disclaimer, the term of this patent is extended or adjusted under 35 U.S.C. 154(b) by 623 days.

(21) Appl. No.: 13/032,917

(22) Filed: Feb. 23, 2011

(51) Int. Cl.
*H01Q 1/38* (2006.01)

(52) U.S. Cl.
USPC ..... 343/700 MS; 343/702; 343/846; 343/848

(58) Field of Classification Search
CPC ..... H01Q 1/243; H01Q 1/2291; H01Q 1/246
USPC ..... 343/700 MS, 702, 846, 848
See application file for complete search history.

(56) References Cited

U.S. PATENT DOCUMENTS

| | | | | |
|---|---|---|---|---|
| 5,038,151 | A | 8/1991 | Kaminski | |
| 5,926,137 | A * | 7/1999 | Nealy | 343/700 MS |
| 5,966,094 | A | 10/1999 | Ward et al. | |
| 6,639,558 | B2 * | 10/2003 | Kellerman et al. | 343/700 MS |
| 6,760,318 | B1 | 7/2004 | Bims | |
| 6,788,658 | B1 | 9/2004 | Bims | |
| 6,812,891 | B2 * | 11/2004 | Montgomery et al. | 343/700 MS |
| 6,839,038 | B2 | 1/2005 | Weinstein | |
| 6,894,649 | B2 | 5/2005 | Ostervall | |
| 6,933,909 | B2 | 8/2005 | Theobold | |
| 6,954,177 | B2 | 10/2005 | Channabasappa et al. | |
| 6,978,158 | B2 | 12/2005 | Ghavami | |
| 7,171,215 | B2 | 1/2007 | Khouaja et al. | |
| 7,197,308 | B2 | 3/2007 | Singhal et al. | |
| 7,319,685 | B2 | 1/2008 | Kim et al. | |
| 7,333,455 | B1 | 2/2008 | Bolt et al. | |
| 7,359,362 | B2 | 4/2008 | King et al. | |
| 7,400,604 | B2 | 7/2008 | Lee et al. | |
| 7,403,506 | B2 | 7/2008 | Lee et al. | |
| 7,406,319 | B2 | 7/2008 | Kostic et al. | |
| 7,466,981 | B1 | 12/2008 | Abdelhamid et al. | |
| 7,515,909 | B2 | 4/2009 | Jain et al. | |
| 7,555,287 | B1 | 6/2009 | Heinonen et al. | |

(Continued)

FOREIGN PATENT DOCUMENTS

| | | |
|---|---|---|
| JP | 2005311580 | 11/2005 |
| JP | 2006229972 | 8/2006 |

OTHER PUBLICATIONS

Ponnapalli et al. "Design and packaging of antennas for wireless systems." Proceedings of Electrical Performance of Electrical Packaging, 1995 (abstract).

(Continued)

*Primary Examiner* — Dameon E Levi
*Assistant Examiner* — Collin Dawkins
(74) *Attorney, Agent, or Firm* — Law Office of Dorian Cartwright

(57) ABSTRACT

A dual-band antenna including a ground plane, a first resonating plate that resonates in a first frequency band, a first shorting plate that shorts the first resonating plate to the ground plane, a second resonating plate that resonates in a second frequency band, with the second resonating plate raised above the first resonating plate with respect to the ground plane, and a second shorting plate that shorts the second resonating plate to the first resonating plate. Also, a dual-stack dual-band MIMO antenna comprising four dual-band antennas arranged in a square or rectangular pattern.

1 Claim, 2 Drawing Sheets

(56) References Cited

U.S. PATENT DOCUMENTS

| | | | | |
|---|---|---|---|---|
| 2005/0152314 | A1 | 7/2005 | Sun et al. | |
| 2006/0025127 | A1 | 2/2006 | Cromer et al. | |
| 2006/0111112 | A1 | 5/2006 | Maveddat | |
| 2006/0208954 | A1 * | 9/2006 | Han et al. | 343/767 |
| 2007/0213071 | A1 | 9/2007 | Hwang | |
| 2008/0102835 | A1 | 5/2008 | Zhao et al. | |
| 2008/0153497 | A1 | 6/2008 | Kalhan | |
| 2008/0165866 | A1 | 7/2008 | Teo et al. | |
| 2008/0212535 | A1 | 9/2008 | Karaoguz et al. | |
| 2008/0242305 | A1 | 10/2008 | Kahlert et al. | |
| 2008/0287130 | A1 | 11/2008 | Laroia et al. | |
| 2009/0022127 | A1 | 1/2009 | Traynor et al. | |
| 2009/0061873 | A1 | 3/2009 | Bao et al. | |
| 2009/0061879 | A9 | 3/2009 | Gallagher et al. | |
| 2009/0111472 | A1 | 4/2009 | Promenzio | |
| 2009/0174611 | A1 * | 7/2009 | Schlub et al. | 343/702 |

OTHER PUBLICATIONS

Sarolic. "Base station antenna near-field radiation pattern distortion analysis." Sixth International Conference on Computational Methods for the Solution of Electrical and Electromagnetic Engineering Problems Incorporating Electromagnetic Effects on Human Beings and Equipment Seminar, 2003 (abstract).

Yaakob et al. "An integration of mobile motion prediction with dedicated solicitation message for seamless handoff provisioning in high speed wireless environment." 2008 International Conference on Electronic Design, Dec. 1-3, 2008, Pernang, Malaysia, pp. 1-5.

Wei et al. "Seamless handoff support in wireless mesh networks." IEEE 2006, pp. 1-8.

Zhou et al. "A seamless handoff scheme for Mobile IP." IEEE Vehicular Technology Conference, 2006, vol. 2, pp. 927-931.

Amir. "Fast handoff for seamless wireless mesh networks." MobiSys '06, Jun. 19-22, 2006, pp. 83-95, ACM, Uppsala, Sweden.

Chen et al. "A seamless handoff mechanism for DHCP-Based IEEE 802.11 WLANS." IEEE Communications Letters, Aug. 2007, pp. 665-667, vol. 1, No. 8.

Cheung et al. "Network configurations for seamless support of CDMA soft handoffs between cell clusters." IEEE Journal on Selected Areas in Communications, Sep. 1997, pp. 1276-1288, vol. 15, No. 7.

Chui et al. "An Access point coordination system for improved VoIP/WLAN handover performance." IEEE 2006, pp. 501-505

Fan et al. "Managing heterogeneous access networks." 32nd IEEE Conference on Local Computer Networks, IEEE 2007, pp. 651-658.

Habib et al. "Multi-antenna techniques for OFDM based WLAN." Proceedings of First International Conference on Next-Generation Wireless Systems, Jan. 2006, pp. 186-190.

Huang et al. "Incorporating A selection and call admission control for seamless handoff procedure." Proceedings of the International Conference on Computer and Communication Engineering 2008, 2008, pp. 823-826.

Huang et al. "SAP: Seamless authentication protocol for vertical handoff in heterogeneous wireless networks." Third International Conference on Quality of Service in Heterogeneous Wired/Wireless Networks, Aug. 7-9, 2006, ACM, Waterloo, ON, Canada, pp. 1-10.

Kist. "Instant handoffs for wireless infrastructure meshed networks," Proceedings of the 2008 Australasian Telecommunication Networks and Applications Conference, 2008, pp. 288-293.

Kitahara et al. "A base station adaptive antenna for downlink transmission in a DS-CDMA system." IEEE 51st Vehicular Technology Conference Proceedings, 2000 (abstract).

Liao et al. "Practical schemes for smooth MAC layer handoff in 802.11 wireless networks." Proceedings of the 2006 International Symposium on a World of Wireless, Mobile and Multimedia Networks, IEEE, pp. 1-10.

LV. "Intelligent seamless vertical handoff algorithm for the next generation wireless networks." Mobilware '08, Feb. 12-15, 2008, Innsbruck, Austria, pp. 1-10.

Mahler et al. "Design and optimisation of an antenna array for WiMAX base stations." IEEE/ACES International Conference on Wireless Communications and Applied Computational Electromagnetics, 2005 (abstract).

Manodham et al. "A Seamless handoff scheme with new AP module for wireless LANs support VoIP." Proceedings of the 2005 Symposium on Applications and the Internet. IEEE, 2006, pp. 1-6.

Miaris et al. "On the base stations antenna system design for mobile communications." Electrical Engineering, 2006, vol. 88, pp. 157-163.

Miura et al. "Study of array pattern tuning method using hybrid genetic algorithms for figure-8 satellite's earth station antenna." Asia-Pacific Microwave Conference Proceedings, 2000 (abstract).

Murray et al. "Intelligent access and mobility management in heterogeneous wireless networks using policy." First International Workshop on Information and Communication Technologies, ACM, 2003, pp. 181-186.

* cited by examiner

DUAL-STACK DUAL-BAND MIMO ANTENNA

BACKGROUND

One type of antenna commonly used with mobile devices is a PIFA antenna. PIFA antennas typically include a ground plane, a top plate element, a feed wire feeding the resonating top plate, and a DC-shorting plate that connects the ground plane and one end of the resonating plate. An impedance element also can be included between the ground plane and the resonating plate. PIFA antennas generally are designed to work around one band of frequencies and typically display "nulls" in frequencies outside of that frequency band.

In some IEEE wireless communication standards, MIMO (multiple-input multiple-output) devices can use more than one transmitting and receiving antenna, the transmitting and receiving antennas being physically separated, with the effect that multiple signals can be transmitted and received concurrently using the same communication channel. For example and without limitation, a $1^{st}$ MIMO device having antennae 1*a* and 1*b* can communicate with a $2^{nd}$ MIMO device having antennae 2*a* and 2*b*, using a substantially single communication channel, by communicating between antennae 1*a* and 2*a* and between antennae 1*b* and 2*b*. Alternatively, the $1^{st}$ and $2^{nd}$ MIMO devices might communicate between antennae 1*a* and 2*b* and between antennae 1*b* and 2*a*. Communication channels are described herein primarily with respect to distinct carrier frequencies; however, in the context of the invention, there is no need for any particular limitation. For example and without limitation, communication channels might include CDMA or TDMA access to a common communication medium.

One known problem in MIMO antenna design is to substantially reduce correlation between and among received signals at the receiving end of a pair of communicating devices' antennae. While this is relatively easy to achieve in a scattering-rich environment, an environment that is not so conducive to MIMO operation is subject to drawbacks when the antennae themselves do not exhibit operational diversity. Moreover, in IEEE 802.11 protocols which use MIMO to advantage, it is relatively difficult to achieve the advantages of MIMO operation concurrently with respect to more than one communication channel, as antennae that are relatively effective for MIMO operation for a $1^{st}$ communication channel, such as for example a $1^{st}$ frequency, can be subject to substantial inefficiency for MIMO operation for a $2^{nd}$ communication channel, such as for example a $2^{nd}$ frequency. For example, standard PIFA antennas tend not to be able to operate in both 2.4 GHz and 5.0 GHz channels. This can pose a significant drawback in IEEE 802.11 protocols in which MIMO operation in combined with operation using more than one carrier frequency.

SUMMARY OF THE DESCRIPTION

This description includes techniques, including methods, physical articles, and systems, which provide communication in which the antennae themselves exhibit operational diversity. For example and without limitation, multiple antennae might operate more effectively if they exploit space diversity (for example and without limitation, spacing antennae at some substantial distance), pattern diversity (for example and without limitation, operating antennae with substantially distinct radiation patterns, such as for example, radiation patterns which are substantially orthogonal), polarization diversity (for example and without limitation, operating antennae with substantially distinct polarization, such as for example, orthogonal planar polarization or otherwise distinct circular polarization).

Moreover, in communication protocols that use MIMO to advantage, the description includes techniques, including methods, physical articles, and systems, which provide communication in which MIMO might be used effectively.

Such techniques might include arranging antennae in particular manners, structures and arrangements of antennas, and systems including such structures and arrangements.

REAL-WORLD NATURE

Figure 1:
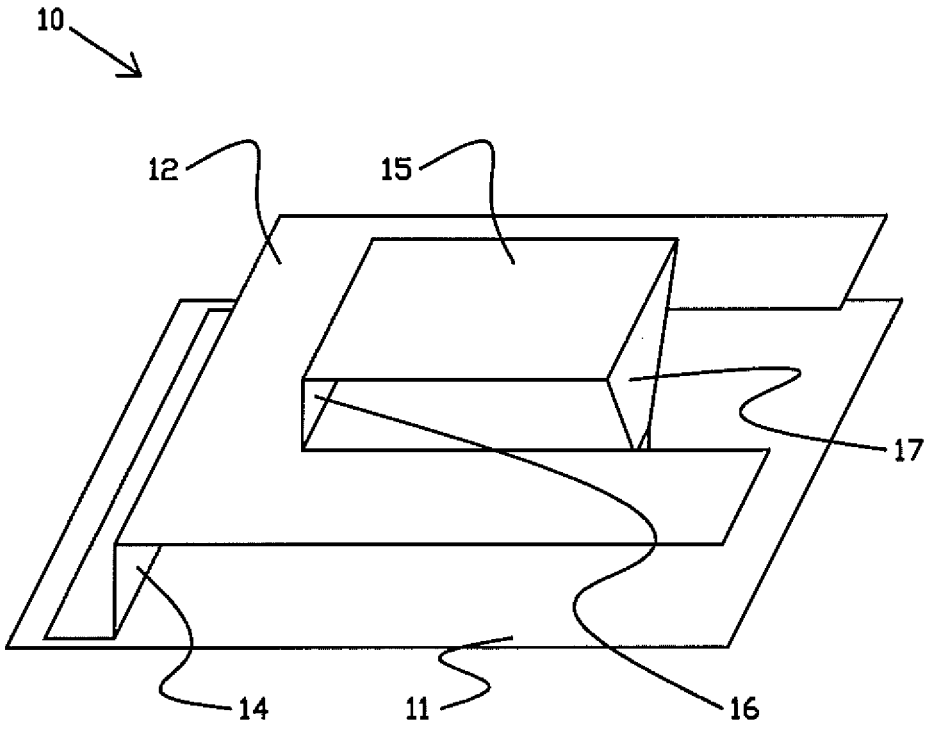
FIG. 1 shows a dual-band antenna.

The invention includes techniques, including methods, physical articles, and systems, that receive real-world information dictated by real-world conditions (not mere inputs to a problem-solving technique). The techniques provided by the invention are transformative of the information received, at least in the sense that incoming data is reordered and allocated to particular times and priorities. This has the effect that a $1^{st}$ type of information (e.g., incoming message units) is transformed into a $2^{nd}$ type of information (e.g., relative priority of outgoing message units).

The invention includes techniques that are tied to a particular machine, at least in the sense that allocation of time and bandwidth is performed in a communication system. While this description is primarily directed to that portion of the invention in which an AP plays a prominent role, this description also shows that an AP alone (i.e., without appropriate instructions) be sufficient to perform methods, or comprise systems, within the scope and spirit of the invention.

DESCRIPTION

Generality of the Description

This application should be read in the most general possible form. This includes, without limitation, the following:

- References to specific techniques include alternative and more general techniques, especially when discussing aspects of the invention, or how the invention might be made or used.
- References to "preferred" techniques generally mean that the inventors contemplate using those techniques, and think they are best for the intended application. This does not exclude other techniques for the invention, and does not mean that those techniques are necessarily essential or would be preferred in all circumstances.
- References to contemplated causes and effects for some implementations do not preclude other causes or effects that might occur in other implementations.
- References to reasons for using particular techniques do not preclude other reasons or techniques, even if completely contrary, where circumstances would indicate that the stated reasons or techniques are not as applicable.

The invention is not in any way limited to the specifics of any particular examples disclosed herein. Many other variations are possible which remain within the content, scope and spirit of the invention, and these variations would become clear to those skilled in the art after perusal of this application.

DEFINITIONS AND NOTATIONS

The following definitions and notations are exemplary, and not intended to be limiting in any way:

The phrases "PIFA" and the like generally refer to planar inverted-F antennas. PIFA antennas can also be referred to as "grounded patch antennas." PIFA antennas are often used in or by portable wireless devices, although they can be used for many other applications.

The phrases "MIMO" and the like generally refer to multiple-input and multiple-output, for example the use of multiple antennas at both a transmitter and receiver to improve communication performance.

After reading this application, those skilled in the art would recognize that these definitions and notations would be applicable to techniques, methods, physical elements, and systems—not currently known, or not currently known to be applicable by the techniques described herein—including extensions thereof that would be inferred by those skilled in the art after reading this application, even if not obvious to those of ordinary skill in the art before reading this application.

FIGURES AND TEXT

Where described as shown in a figure, an element might include other items shown in the figure in addition to, or operating in combination or conjunction with, that particular element (or that particular element in combination or conjunction with other elements, whether shown or not shown in the figure, and whether described or not described with respect to the figure).

other items not shown in the figure, but whose inclusion would be known to those skilled in the art, or which would be known after reasonable investigation, without further invention or undue experimentation.

subparts of that element, whether shown or not shown in the figure, which might be convenient for operation of the element, but which are not necessarily required in the described context, or which might be necessary for operation of the element in the described context, but which are not necessary for description at a level understandable to those skilled in the art.

FIG. 1

FIG. 1 shows a dual-band antenna. The antenna bands preferably are located at 2.4 GHz and 5.0 GHz to match various IEEE 802.11 protocols. While this description is primarily directed to devices using these known antenna bands, in the context of the invention, there is no reason for that or any other particular limitation. For example and without limitation, other frequencies might be used.

Antenna 10 in FIG. 1 includes ground plane 11, first resonating plate 12, first shorting plate 14, second resonating plate 15, second shorting plate 16, and impedance stub 17.

Ground plane 11 preferably includes an electrically conductive surface that preferably extends at least over an area covered by first resonating plate 12 and second resonating plate 15. In one embodiment, this area is a 3.8 inch by 4.85 inch rectangle. While this description is primarily directed to devices using these sizes and shapes, in the context of the invention, there is no reason for those or any other particular limitations. For example and without limitation, other sizes and shapes might be used.

First resonating plate 12 preferably includes a U-shaped piece of conductive material. In FIG. 1, this U-shape includes two substantially rectangular portions joined by a third substantially rectangular portion. While this description is primarily directed to devices using this shape, in the context of the invention, there is no reason for that or any other particular limitation. For example and without limitation, other shapes might be used.

First resonating plate 12 preferably resonates around a first frequency, for example and without limitation 2.4 GHz. The resonant frequency and bandwidth of first resonating plate 12 can be determined or designed through calculation of the relevant electromagnetic properties, computer modeling, experimentation, and the like.

First shorting plate 14 shorts first resonating plate 12 to ground plane 11 in FIG. 1. The shorting plate can include flange 18 for mounting antenna 10 onto ground plane 11 and shorting first plate to 12 to ground plane 11, as shown. While this description is primarily directed to devices using this technique for mounting and for shorting, in the context of the invention, there is no reason for those or any other particular limitations. For example and without limitation, other arrangements for mounting and shorting might be used.

Second resonating plate 15 preferably includes a rectangular shaped piece of conductive material raised above first resonating plate 12 with respect to the ground plane. While this description is primarily directed to devices using this shape, in the context of the invention, there is no reason for this or any other particular limitations. For example and without limitation, other shapes might be used.

Second resonating plate 15 preferably resonates around a second frequency, for example and without limitation 5.0 GHz. The resonant frequency and bandwidth of second resonating plate 15 can be determined or designed through calculation of the relevant electromagnetic properties, computer modeling, experimentation, and the like.

Second shorting plate 16 shorts first resonating plate 12 to second resonating plate 15 in FIG. 1. While this description is primarily directed to devices using this shorting arrangement, in the context of the invention, there is no reason for this or any other particular limitations. For example and without limitation, other shorting arrangements might be used.

Impedance stub 17 connects second resonating plate 15 to ground plane 11, preferably without contacting first resonating plate 12. In FIG. 1, this is achieved by impedance stub's triangular shaped portion. While this description is primarily directed to devices using these shapes and arrangements, in the context of the invention, there is no reason for these or any other particular limitations. For example and without limitation, other shapes and arrangements might be used.

Impedance stub 17 can include impedance for antenna 10, for example to match a 50 Ohm impedance requirement for the antenna. While this description is primarily directed to devices using this value of impedance, in the context of the invention, there is no reason for this or any other particular limitation. For example and without limitation, other values of impedance might be used.

Each of the elements described above can be formed from one piece of material cuts and bent accordingly. Alternatively, some of the elements can be formed separately and then joined to the antenna. While this description is primarily directed to devices using this manufacturing technique, in the context of the invention, there is no reason for this or any other particular limitation. For example and without limitation, other manufacturing techniques might be used.

A signal preferably is fed to antenna 10 through a feed connected directly to one or more of the resonating plates and shorting plates.

Antennas designed as described above tend to exhibit linear polarization in both frequency bands. While this description is primarily directed to devices using linear polarization, in the context of the invention, there is no reason for this or any other particular limitation. For example and without limitation, other types of polarization, e.g., circular polarization, might be used.

FIG. 2

Figure 2:
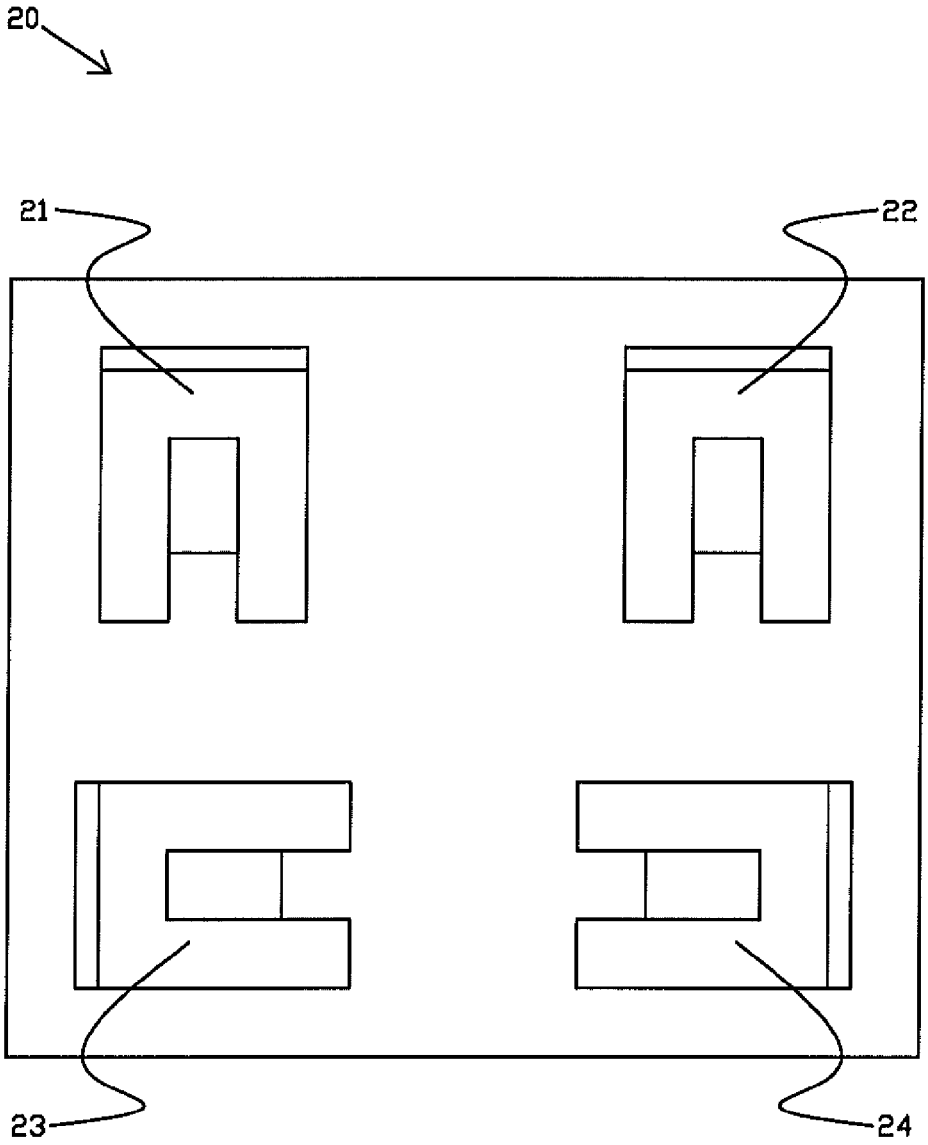
FIG. 2 shows a dual-stack dual-band MIMO antenna that includes four dual-band antennas.

FIG. 2 shows a dual-stack dual-band MIMO antenna that includes four dual-band antennas, for example of the type shown in FIG. 1.

Dual-stack dual-band MIMO antenna 20 in FIG. 2 includes dual-band antennas 21, 22, 23, and 24. These antennas preferably are arranged in a square or rectangular pattern on a plane. In FIG. 2, this plane includes the ground planes of the antennas. While this description is primarily directed to devices in which the antennas are located in their mutual ground plane, in the context of the invention, there is no reason for this or any other particular limitation. For example and without limitation, other planar, or non-planar, bases might be used.

In some embodiments, some or all of the antennas can share a ground plane or the antennas' ground planes can be connected. While this description is primarily directed to devices in which the antennas can share a ground plane or the antennas' ground planes can be connected, in the context of the invention, there is no reason for this or any other particular limitation. For a $1^{st}$ example and without limitation, antennas need not share a ground plane. For a $2^{nd}$ example and without limitation, antennas' ground planes need not be connected, e.g., the ground planes can be isolated from each other.

In a preferred embodiment, a radio can share a pair of antennas that are catty-corner from each other. For example and without limitation, a first radio (not shown) could share antennas 21 and 23, and a second radio (not shown) could share antennas 22 and 24. While this description is primarily directed to devices in which each pair of antennas are disposed catty-corner from each other, in the context of the invention, there is no reason for this or any other particular limitation. For example and without limitation, antennas might be disposed on a non-rectilinear base and might be oriented substantially differently, e.g., the antennas might be disposed at 90-degree angles around a circular base.

Antennas that exhibit polarization and that are shared by a radio preferably are oriented orthogonally to each other. This arrangement can help decrease interference for MIMO and other operations. Thus, as shown in FIG. 2, antennas 21 and 23 are oriented orthogonally from each other, as are antennas 22 and 24.

This arrangement of dual-band antennas to form a dual-stack dual-band MIMO antenna has been found to work well with MIMO operations in multiple frequency bands. While this description is primarily directed to devices making use of MIMO effects in the placement of antennas, in the context of the invention, there is no reason for this or any other particular limitation. For example and without limitation, devices and antennas might be disposed and oriented similarly, but without making use of MIMO effects.

ALTERNATIVE EMBODIMENTS

The invention has applicability and generality to other aspects of wireless communication. It is not limited to wireless communication based upon 802.11 standards, nor is it limited to any particular IEEE standard, or even to any particular communication standard. One having skill in the art will recognize that the systems and methods disclosed herein may be effectuated using other techniques.

The invention claimed is:

1. A dual-band antenna for wireless communication utilizing a MIMO (multiple-input multiple-output) antenna array operating in multiple frequency bands, comprising:

at least four dual-band antennas arranged in a square or rectangular pattern, wherein each antenna exhibits linear polarization, and wherein catty-corner antennas are arranged orthogonally in terms of their polarization, wherein each of the dual-band antenna comprises:

a ground plane;

a first resonating plate that resonates in a first frequency band;

a first shorting plate that shorts the first resonating plate to the ground plane;

a second resonating plate that resonates in a second frequency band, with the second resonating plate raised above the first resonating plate with respect to the ground plane, wherein the first frequency band operates at 2.4 GHz and the second frequency band operates at 5.0 GHz, the antenna exhibiting linear polarization in both the first frequency band and the second frequency band;

a second shorting plate that shorts the second resonating plate to the first resonating plate; and an impedance stub that connects the second resonating plate to the ground plane, wherein the impedance stub has a triangular shaped portion that avoids contact with the first resonating plate.

* * * * *